US010132335B2

(12) United States Patent
Wutke et al.

(10) Patent No.: US 10,132,335 B2
(45) Date of Patent: Nov. 20, 2018

(54) ENERGY MANAGEMENT SYSTEM FOR MACHINERY PERFORMING A PREDICTABLE WORK CYCLE

(71) Applicant: Harnischfeger Technologies, Inc., Wilmington, DE (US)

(72) Inventors: Joe Wutke, Muskego, WI (US); William A. Dorsett, Longview, TX (US); Marcus N. Barr, Longview, TX (US); Jason Sorgee, White Oak, TX (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 328 days.

(21) Appl. No.: 14/034,042

(22) Filed: Sep. 23, 2013

(65) Prior Publication Data

US 2014/0083089 A1 Mar. 27, 2014

Related U.S. Application Data

(60) Provisional application No. 61/703,879, filed on Sep. 21, 2012.

(51) Int. Cl.
*E02F 9/20* (2006.01)
*F15B 15/18* (2006.01)
(Continued)

(52) U.S. Cl.
CPC ..... *F15B 15/18* (2013.01); *E02F 3/437* (2013.01); *E02F 9/2075* (2013.01); *E02F 9/265* (2013.01)

(58) Field of Classification Search
CPC ..... E02F 9/2091; E02F 9/20; E02F 9/2075; E02F 9/2217; E02F 9/265; E02F 3/437; F15B 15/18
(Continued)

(56) References Cited

U.S. PATENT DOCUMENTS 5,103,923 A 4/1992 Johnston et al.
5,351,775 A 10/1994 Johnston et al.
(Continued)

FOREIGN PATENT DOCUMENTS

CN 102325947 1/2012
CN 102459769 5/2012
(Continued)

OTHER PUBLICATIONS

PCT/US2013/061192 International Search Report and Written Opinion dated Feb. 14, 2014 (12 pages).
(Continued)

*Primary Examiner* — Kimberly S Berona
*Assistant Examiner* — Nadeem Odeh
(74) *Attorney, Agent, or Firm* — Michael Best & Friedrich LLP

(57) ABSTRACT

Industrial machines and methods of operating the same. One industrial machine includes at least one controller that is configured to (1) detect an occurrence of a regenerative work cycle segment within a repetitive work cycle performed by the industrial machine and including a plurality of work cycle segments and (2) modify operation of at least one power source included in the industrial machine for the regenerative work cycle segment (i.e., prior to and/or during the regenerative work cycle segment).

21 Claims, 5 Drawing Sheets

(51) Int. Cl.
*E02F 3/43* (2006.01)
*E02F 9/26* (2006.01)

(58) Field of Classification Search
USPC ..... 701/50, 36
See application file for complete search history.

(56) References Cited

U.S. PATENT DOCUMENTS

| | | | | |
|---|---|---|---|---|
| 5,493,798 | A * | 2/1996 | Rocke et al. | 37/348 |
| 8,286,740 | B2 | 10/2012 | Kagoshima et al. | |
| 8,297,392 | B2 | 10/2012 | Treichel et al. | |
| 8,831,805 | B2 * | 9/2014 | Izumi et al. | 701/22 |
| 2009/0120083 | A1 * | 5/2009 | Peterson | E02F 9/2228 60/327 |
| 2010/0102763 | A1 | 4/2010 | Kagoshima et al. | |
| 2010/0332061 | A1 * | 12/2010 | Forslow et al. | 701/22 |
| 2011/0073392 | A1 | 3/2011 | Collins et al. | |
| 2011/0233931 | A1 * | 9/2011 | Weber | F04B 1/04 290/7 |
| 2011/0251746 | A1 | 10/2011 | Wu et al. | |
| 2011/0313608 | A1 | 12/2011 | Izumi et al. | |
| 2012/0082536 | A1 | 4/2012 | Kawashima et al. | |
| 2012/0086220 | A1 * | 4/2012 | Abdel-Baqi | E02F 9/0808 290/40 B |
| 2014/0083089 | A1 | 3/2014 | Wutke et al. | |
| 2014/0147238 | A1 * | 5/2014 | Izumi et al. | 414/687 |

FOREIGN PATENT DOCUMENTS

| | | | |
|---|---|---|---|
| JP | 2002-359935 | | 12/2002 |
| JP | 2002359935 | A | 12/2002 |
| JP | 2010133235 | | 6/2010 |
| JP | 2011047210 | | 3/2011 |
| WO | WO 2010114036 | A1 * | 10/2010 |
| WO | 2012-050010 | | 4/2012 |
| WO | 2012050010 | A1 | 4/2012 |

OTHER PUBLICATIONS

Abstract of Guan, Cheng et al., Recovering System of Swing Braking Energy in Hydraulic Excavator, Journal of Zhejiang University (Jan. 2012) v 46, pp. 142-149.

Anonymous, MINExpo Brings it All Together: Engineering, Geology, Mineralogy, Metallurgy, Chemistry, etc., Engineering and Mining Journal (Nov. 2008) pp. 30,32,34,36,38,40,42,44,46,48,50,52,54,56,58,60,62,64,66,68-69.

Van Hampton, Tudor, How John Deere's New Hybrid Wheel Loaders Get Their Juice, Engineering News-Record (Jun. 2011) vol. 266, 3 pages.

Letournear Training "SR Energy Recovery," slide, (first presented in 2008) 3 pages.

Second Office Action from the Chilean Patent Office for Application No. 2696-2014 dated May 8, 2016 (9 pages).

Office Action from the Chilean Patent Office for Application No. 2696-2014 dated Dec. 15, 2015 (7 pages).

First Office Action from the State Intellectual Property Office of China for Application No. 201380017934.X dated Jul. 7, 2016 (17 pages).

* cited by examiner

ENERGY MANAGEMENT SYSTEM FOR MACHINERY PERFORMING A PREDICTABLE WORK CYCLE

RELATED APPLICATIONS

The present application claims priority to U.S. Provisional Application No. 61/703,879 filed Sep. 21, 2012, the entire contents of which is incorporated by reference herein.

FIELD

Embodiments of the present invention relate to systems and methods for managing regenerated energy harvested during operation of machinery, devices, or systems performing a predictable work cycle, such as shovels or excavators used in mining environments.

SUMMARY

Mining shovels, such as electric rope or power shovels, are used to remove material from, for example, a bank of a mine. An operator controls a shovel during a dig operation to load a dipper with materials. The operator deposits the materials contained in the dipper at a dumping location, such as into a haul truck, into a mobile crusher, onto an area on the ground, onto a conveyor, etc. After unloading the materials, the dig cycle continues and the operator swings the dipper back to the bank to perform additional digging.

During operation, the work cycle of a shovel is repetitive. For example, a shovel's work cycle typically includes a dig segment, a swing segment, a dump segment, and a return segment. These segments are repeated with minor variations (e.g., due to digging conditions). Therefore, work cycle segments of a shovel are predictable, and work cycle decomposition algorithms have been developed and incorporated into heavy equipment controllers for providing semi-autonomous control, machine monitoring, and operator performance monitoring. The algorithms can determine work cycle segments based on motion, position, speed, torque, etc. of the shovel, or, more particularly, the dipper.

Accordingly, embodiments of invention use the predictability of work cycle segments to efficiently harvest energy during regenerative portions of a work cycle and improve machine energy usage (i.e., minimize fuel consumption). In particular, one embodiment of the invention provides an industrial machine that includes at least one controller. The controller is configured to (1) detect an occurrence of a regenerative work cycle segment within a repetitive work cycle including a plurality of work cycle segments performed by the industrial machine and (2) modify operation of at least one power source included in the industrial machine for the regenerative work cycle segment.

Another embodiment of the invention provides a method of operating an industrial machine. The method includes detecting, by a controller, an occurrence of a regenerative work cycle segment within a repetitive work cycle performed by the industrial machine, the repetitive work cycle including a plurality of work cycle segments. The method also includes modifying, by the controller, operation of the industrial machine for the regenerative work cycle.

Yet another embodiment of the invention provides an energy management system. The energy management system includes a bi-directional power bus and a power conversion unit that receives electrical power from the bi-directional power bus and generates regulated electrical energy. The system also includes an actuator that receives regulated electrical energy from the power conversion unit to operate at least one tool within a repetitive work cycle having a plurality of work cycle segments. The system further includes an engine and a motor-generator coupled to and driven by the engine. The motor/generator generates electrical energy and supplies the electrical power to the bi-directional power bus. In addition, the system includes a controller configured to (1) detecting an occurrence of one of the plurality of work cycle segments during which regenerative power is generated and (2) modify operation of at least one of the engine and the bi-directional power bus for the work cycle segment based on the regenerative power.

Other aspects of the invention will become apparent by consideration of the detailed description and accompanying drawings.

DETAILED DESCRIPTION

Figure 1:
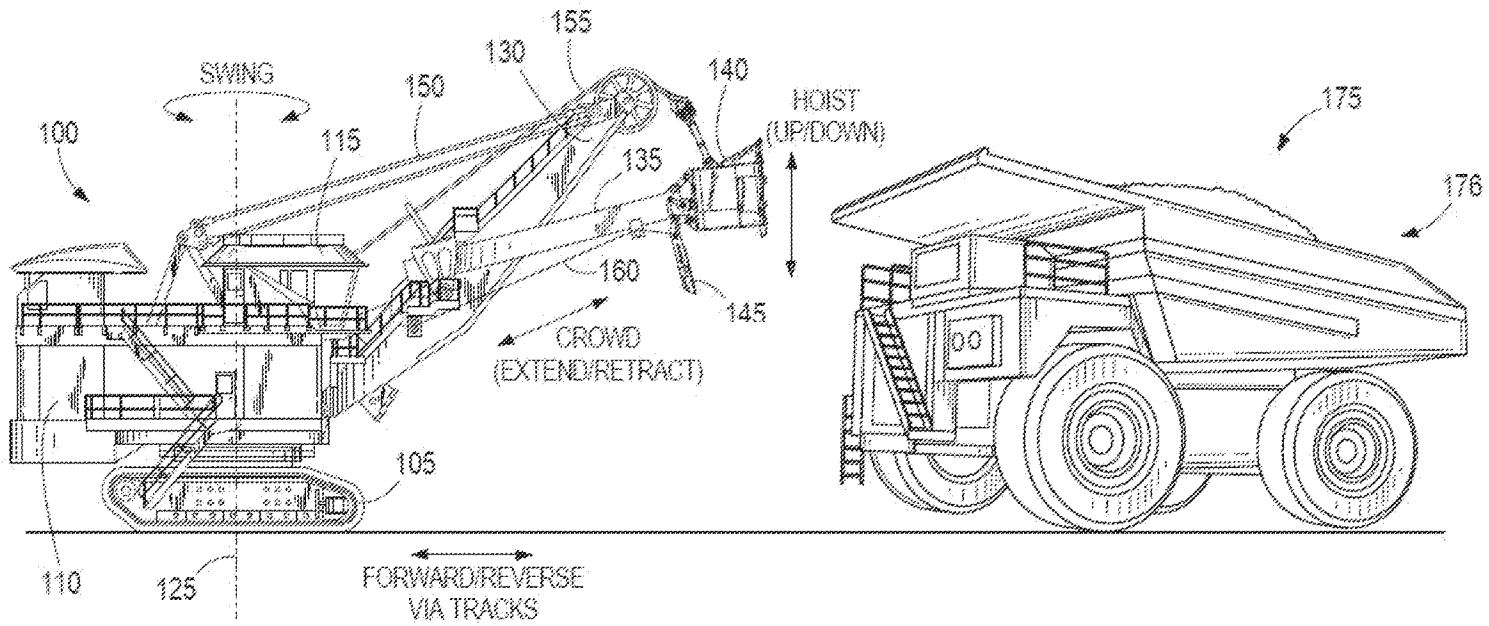
FIG. 1 illustrates a shovel and a haul truck.

Before any embodiments of the invention are explained in detail, it is to be understood that the invention is not limited in its application to the details of construction and the arrangement of or quantity of components set forth in the following description or illustrated in the following drawings. The invention is capable of other embodiments and of being practiced or of being carried out in various ways.

Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should also be noted that a plurality of hardware and software based devices, as well as a plurality of different structural components may be used to implement the invention. In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processing units, such as a microprocessor and/or an application specific integrated circuits ("ASICs").

As such, it should be noted that a plurality of hardware and software based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible. For example, "controllers" described in the specification can include standard processing components, such as one or more processing units, one or more computer-readable medium modules, one or more input/output interfaces, and various connections (e.g., a system bus) connecting the components.

FIG. 1 depicts an exemplary electric rope shovel 100. The rope shovel 100 includes tracks 105 for propelling the rope shovel 100 forward and backward, and for turning the rope shovel 100 (i.e., by varying the speed and/or direction of the left and right tracks relative to each other). The tracks 105 support a base 110 including a cab 115. The base 110 is able to swing or swivel about a swing axis 125 to move, for instance, between a digging location and a dumping location. In some embodiments, movement of the tracks 105 is not necessary for the swing motion. The shovel 100 further includes a boom 130 supporting a pivotable dipper handle 135 and a dipper 140. The dipper 140 can include a door 145 for dumping contents within the dipper 140. During operation, the rope shovel 100 dumps materials contained in dipper 140 into a dumping location, such as the bed 176 of a haul truck 175, by opening the door 145. In some embodiments, rather than including a door 145, the dipper 140 has a clamshell bucket design, which is opened and closed to dig materials and dump materials. It should be understood that although the shovel 100 is illustrated as being used with the haul truck 175, the shovel 100 is also able to dump materials from the dipper 140 into other dumping locations, such as into mobile mining crushers, onto a conveyor, and/or onto an area on the ground.

As also illustrated in FIG. 1, the shovel 100 also includes taut suspension cables 150 coupled between the base 110 and the boom 130 for supporting the boom 130 and a hoist cable 155 attached to a winch (not shown) within the base 110 for winding the cable 155 to raise and lower the dipper 140. The shovel 100 also includes a crowd pinion and a rack on the bottom of the dipper handle 135 for extending and retracting the dipper 140 (i.e., performing a crowd motion of the dipper 140). In addition, in some embodiments, the shovel 100 includes a dipper trip cable 160 for opening and closing the door 145. In some embodiments, in addition to or in place of one or more of the cables 150, the shovel 100 includes one or more tension members that connect the boom 130 to the base 110.

The shovel 100 includes one or more "actuators" for driving or operating one or more "tools." The "actuators" can include electric or hydraulic motors. The "tools" can include various components included in the shovel 100, such as the winches for operating the cables 150 or the handle 135, a mechanism for operating the door 145 (e.g., the cable 160), a mechanism for operating a clamshell design of the dipper 140, mechanisms for swinging the base 110, and mechanisms for operating the tracks 105.

Figure 2:
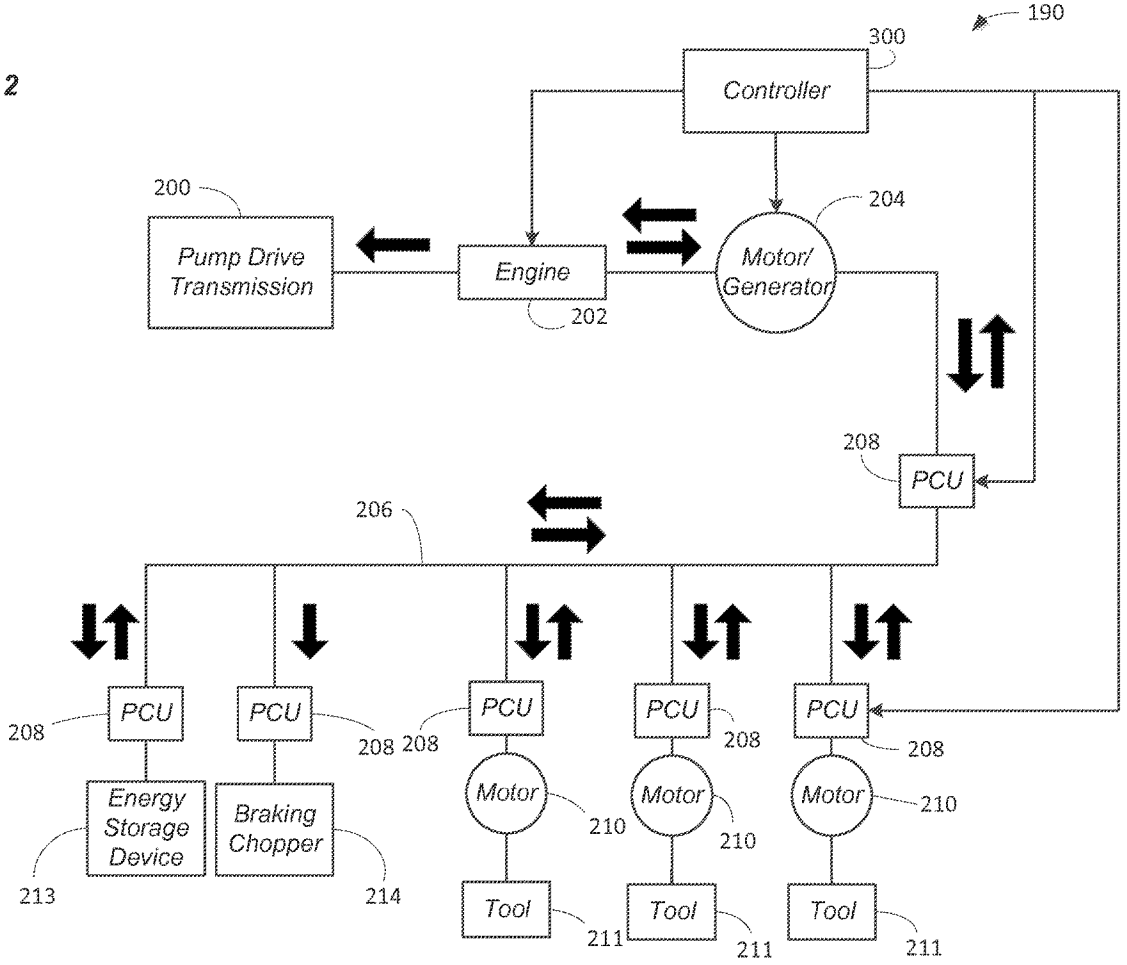
FIG. 2 schematically illustrates an energy management system included in the shovel of FIG. 1.

For example, FIG. 2 illustrates an energy management system 190 included in the shovel 100. The system 190 includes a pump drive transmission 200 and an engine 202 (e.g., a diesel internal combustion engine). The engine 202 is powered using a fuel (e.g., diesel fuel, gasoline, petroleum gas, natural gas, propane, biofuels, hydrogen gas, etc.), which is contained in a fuel supply (not illustrated). The pump drive transmission 200 drives one or more hydraulic motors included in the shovel 100. The hydraulic motors can drive compressors, heating, ventilation, and air conditioning ("HVAC") systems, fans, etc. included in the shovel 100. The pump drive transmission 200 is mechanically coupled to and driven by the engine 202. Although not shown, the engine 202 can also be mechanically coupled to an alternator driven by the engine to generate electrical energy used to power heaters, interior and exterior lights, a stereo, controllers, electronics, pumps, fans, etc. included in the shovel 100.

The engine 202 is also mechanically coupled to a motor-generator 204. The motor-generator 204 is driven by the engine 202 to generate electrical energy. The motor-generator 204 outputs the generated electrical energy to a bi-directional power bus 206. Power conversion units ("PCUs") 208 are also coupled to the bus 206. The PCUs 208 convert the electrical energy available on the bus 206 into regulated electrical energy usable by an actuator (e.g., an electric motor). For example, the PCUs 208 can convert electrical energy available on the bus 206 from a first voltage to a second voltage.

As illustrated in FIG. 2, a PCU 208 can provide regulated electrical energy to one or more electric motors or machines 210. The machines 210 are actuators used to operate and drive tools 211 included the shovel 100, such as the winches for operating the cables 155 and 160. Unused energy remaining on the bus 206 can optionally be stored to one or more energy storage devices 213, such as one or more ultra-capacitors or batteries. As illustrated in FIG. 2, a braking chopper 214 can also be coupled to the bus 206. The braking chopper 214 consumes or dissipates unused energy remaining on the bus 206 (i.e., energy not consumed by the machines 210 and stored to the energy storage devices 213).

As described above in the summary section, an operator operates the shovel 100 to perform a repetitive work cycle that includes a plurality of work cycle segments. The work cycle segments can include a dig segment ("DIG"), a swing segment ("S"), a dump segment ("DUMP"), and a return segment ("R"). In a dig segment, the operator raises the dipper 140 while the dipper 140 is engaged in a bank of material to load material into the dipper 140. Next, in the swing segment, the operator swings the loaded dipper 140, which disengages the dipper 140 from the bank and moves the dipper 140 toward a dumping location, such as a haul truck 175. In the dump segment, with the dipper 140 positioned over the dumping location (e.g., the bed 176 of the haul truck 175), the operator opens the door 145 of the dipper 140 (e.g., using the handle 135) or opens the clamshell bucket of the dipper 140 and dumps the material from the dipper 140 into the dumping location. In the return segment, the operator lowers the dipper 140 to the bank floor to begin another cycle. The operator repeats these segments of the work cycle with minor variations (e.g., based on digging conditions).

Figure 3:
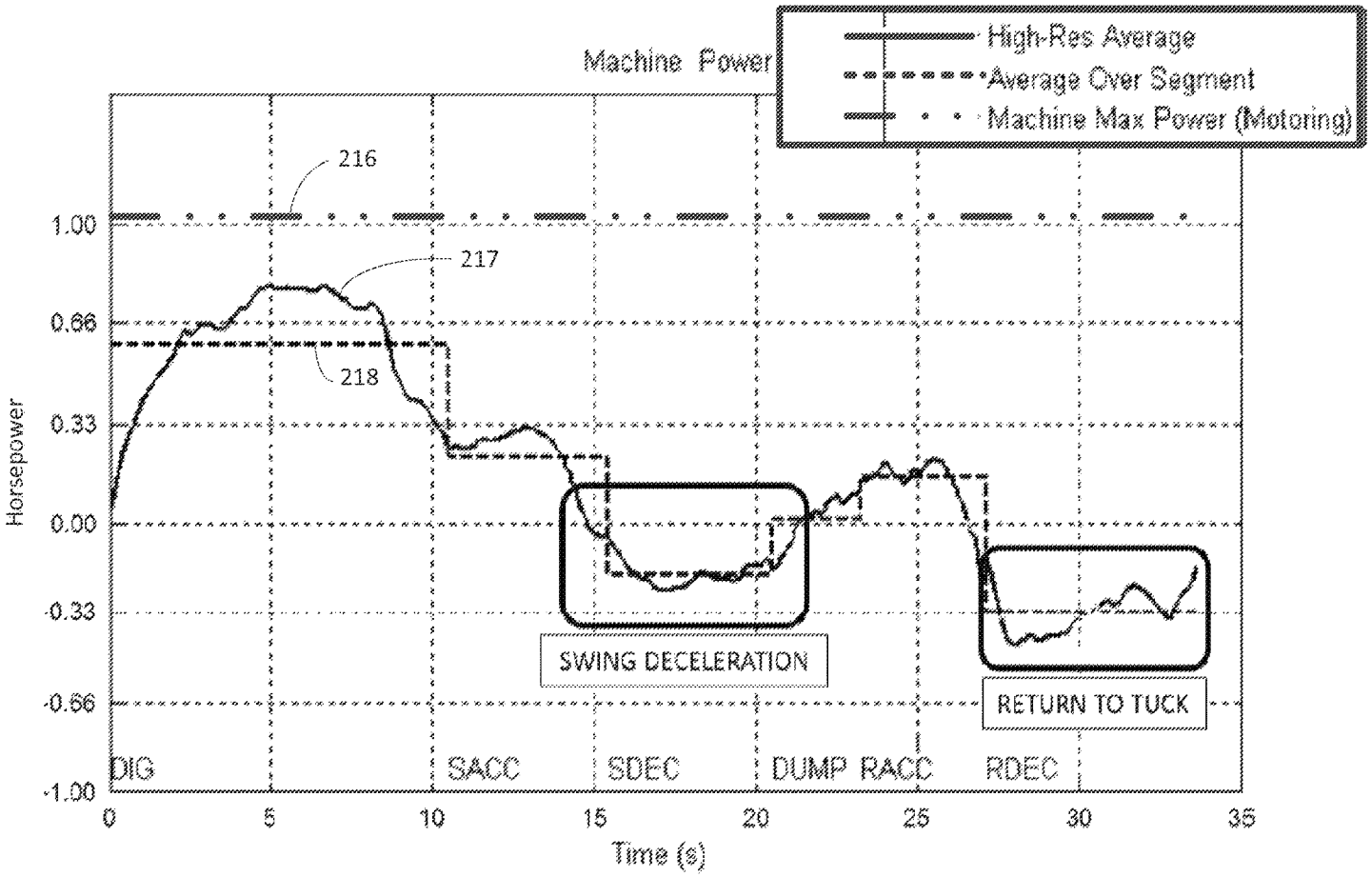
FIG. 3 illustrates power consumption and generation during a work cycle performed by the shovel of FIG. 1.

FIG. 3 illustrates example power consumption of the shovel 100. As illustrated in FIG. 3, the engine 202 can provide a predetermined maximum power of predetermined horsepower (see line 216). However, the actual average horsepower consumed by the shovel 100 over time varies (see line 217). Furthermore, the average horsepower consumed by the shovel 100 over a particular work cycle segment (see dashed line 218) varies between segments. For example, as illustrated in FIG. 3, more power, on average, is consumed during the dig segment than other segments. Also, during the swing segment, more power is consumed when the operator accelerates the dipper 140 during the swing segment ("SACC") (e.g., when starting the dipper swing) than when the operator decelerates the dipper 140 during the swing segment ("SDEC") (e.g., when stopping the dipper swing). Similarly, more power is consumed when the operator accelerates the dipper 140 during the return segment ("RACC") than when the operator decelerates the dipper 140 during the return segment ("RDEC").

As also illustrated in FIG. 3, portions of the work cycle represent regenerative work cycle segments. A regenerative work cycle segment is a work cycle segment (or a portion thereof) where electrical energy is generated due to the braking or slowing of a tool 211. A regenerative work cycle segment can be defined as a work cycle segment when consumed machine power is negative (i.e., the electrical energy produced from regeneration exceeds the energy consumed). As illustrated in FIG. 3, the swing and return segments (e.g., a deceleration portion of the swing segment and a deceleration and return to tuck portion of the return segment) are regenerative work cycle segments. For example, a machine 210 can operate in a "motoring mode" and a "generating mode." In the "motoring mode," a machine 210 acts as a motor and consumes energy to operate and drive one or more of the tools 211. In the "generating mode," a machine 210 generates electrical energy. In particular, during regenerative work cycle segments, one or more of the machines 210 are used to slow or brake a tool 211 by converting the tool's kinetic energy into electrical energy. In particular, when braking a tool 211, the machine 210 is placed in the "generating mode," which causes the machine 210 to slow or stop the tool 211. While in the "generating mode," the machine 210 acts as an electric generator that produces electrical energy. The generated electrical energy is supplied from the machine 210 to a PCU 208 connected to the bus 206 and, ultimately, is supplied to the bus 206. Therefore, while one or more machines 210 are producing electrical energy during a work cycle segment, other electric motion actuators and ancillary loads coupled to the bus 206 (e.g., other machines 210 that are not braking a tool 211) can consume the generated energy. Generated energy can also be stored in energy storage devices 213. However, consuming regenerative energy during operation reduces or eliminates the need to store the harvested energy, which reduces or eliminates the need for energy storage devices, such as ultra-capacitors, batteries, dynamic braking resistors, and related components. Reducing or eliminating these devices results in reduced machine cost and improved reliability. Using the regenerative energy can also reduce energy demand on the engine 202, which reduces energy (e.g., fuel) costs when operating the shovel 100.

Figure 4:
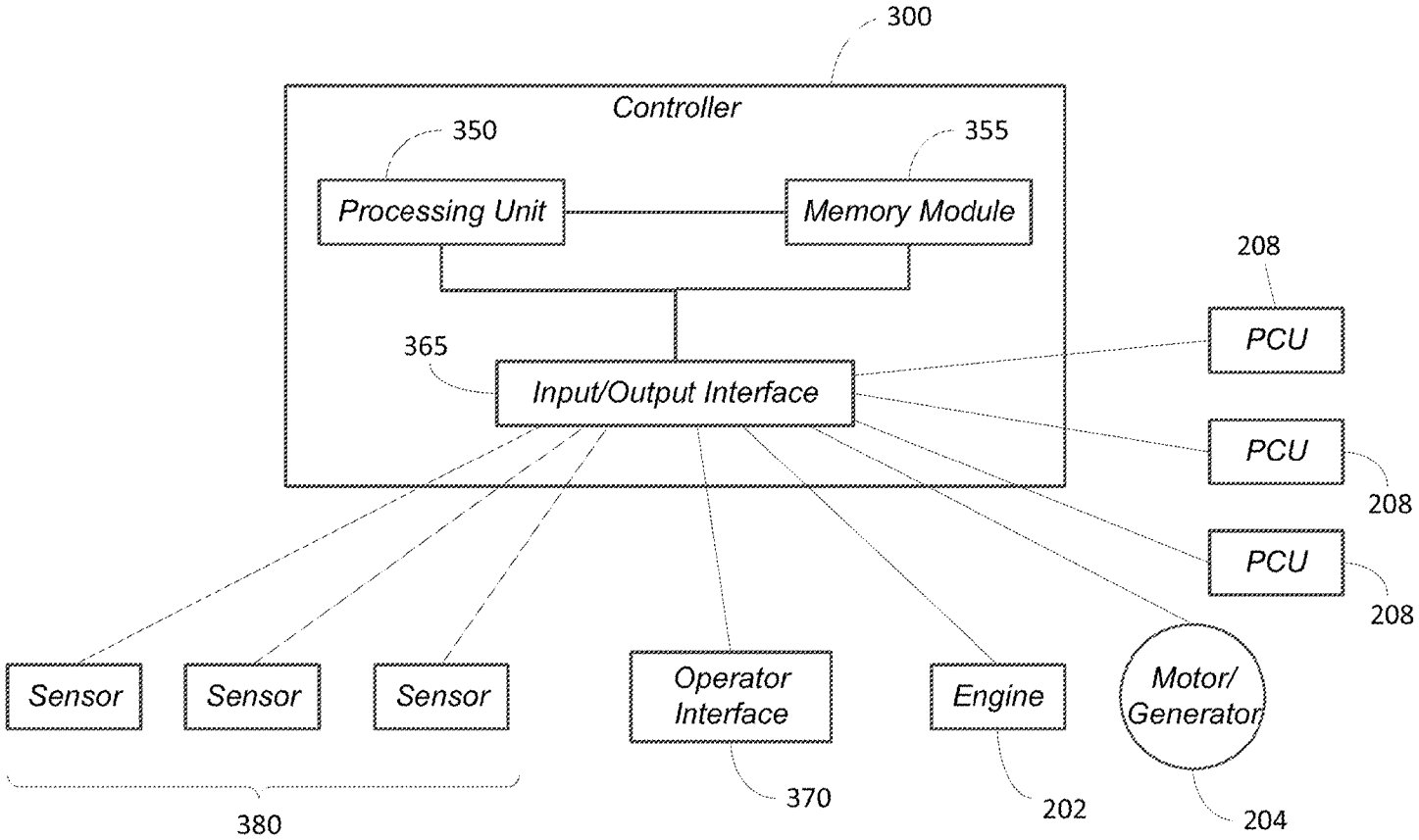
FIG. 4 schematically illustrates a controller included in the energy management system of FIG. 2.

Furthermore, given the predictability of the work cycle segments included in the repetitive work cycle, energy generated and consumed by the shovel 100 can be efficiently managed. For example, as illustrated in FIG. 2, a controller 300 can be included in the energy management system 190 that is configured to perform energy management for the shovel 100. As schematically illustrated in FIG. 4, the controller 300 includes a processing unit 350 (e.g., a microprocessor, an application specific integrated circuit ("ASIC"), etc.), one or more computer-readable memory modules 355, and an input/output interface 365. It should be understood that in some embodiments the controller 300 includes multiple processing units, memory modules, and/or input/output interfaces. Also, in some embodiments, the controller 300 includes additional components than those illustrated in FIG. 4.

The processing unit 350 retrieves and executes instructions and data stored in the computer-readable modules 355. The processing unit 350 also stores data to the computer-readable modules 355 as part of executing instructions. The computer-readable modules 355 includes non-transitory computer readable medium and includes volatile memory, non-volatile memory (e.g., flash memory), or a combination thereof. The input/output interface 365 receives information from devices and systems external to the controller 300 and outputs information to devices and systems external to the controller 300. For example, the input/output interface 365 communicates with the engine 202, the generator 204, and/or one or more of the PCUs 208 using one or more wired or wireless connections. In some embodiments, the input/output interface 365 also stores data received from devices and systems external to the controller 300 to the computer-readable modules 355 and/or retrieves data from the modules 355 to output to the external devices and systems.

As illustrated in FIG. 4, the input/output interface 365 also communicates with an operator interface 370. The operator interface 370 includes one or more operator-controlled input devices, such as joysticks, levers, foot pedals, and other actuators. An operator can use the operator interface 370 to issue motion commands for the shovel 100. The motion commands can include a crowd control, a swing control, a hoist control, propel control, and a door control. The motion commands are used by the controller 300 to output digital motion commands to the PCUs 208 for operating one or more tools 211 as instructed by the operator. The motion commands include, for example, hoist up, hoist down, crowd extend, crowd retract, swing clockwise, swing counterclockwise, dipper door release, left track forward, left track reverse, right track forward, and right track reverse. It should be understood that in some embodiments the operator interface 370 communicates with a controller separate from the controller 300. In these embodiments, the controller 300 communicates with the separate controller to receive the motion commands (e.g., for transmission to the PCUs 208 and/or for internal use as described below in more detail).

As illustrated in FIG. 4, the controller 300 is also in communication with position sensors 380 that monitor the location and/or status of the dipper 140 and/or other components of the shovel 100. For example, in some embodiments, the controller 300 is coupled to one or more crowd sensors, swing sensors, hoist sensors, and shovel sensors. The crowd sensors detect a level of extension or retraction of the dipper 140. The swing sensors detect a swing angle of the handle 135. The hoist sensors detect a height of the dipper 140 based on the hoist cable 155 position. The shovel sensors detect the position of the dipper door (or the clamshell bucket). The shovel sensors can also include load sensors, velocity sensors, acceleration sensors, and inclination sensors that detect information about the load within the dipper 140. In some embodiments, one or more of the sensors 380 include resolvers that indicate an absolute position or relative movement of the motors used to move the dipper 140 (e.g., a crowd motor, a swing motor, and/or a hoist motor). In other embodiments, one or more of the sensors 380 include absolute encoders, linear displacement transducers, or other sensing technology. Again, it should be understood that in some embodiments the sensors 380 communicate with a controller separate from the controller 300. In these embodiments, the controller 300 communicates with the separate controller to receive data from the sensors 380.

The instructions stored in the computer-readable memory modules 355 perform particular functionality when executed by the processing unit 350. For example, the controller 300 executes instructions to perform various energy management methods. In particular, as described in more detail below, the controller 300 executes instructions detect a regenerative work cycle segment performed by the shovel 100 and manage the shovel 100 (e.g., the engine 202, the generator 204, and/or the bus 206) to efficiently provide and consume energy during the identified segment. As used in the present application, the controller 300 "detects" a regenerative work cycle segment by identifying that the current work cycle segment is a regenerative work cycle segment or by predicting that a future (e.g., subsequent) work cycle segment is a regenerative work cycle segment.

Figure 5:
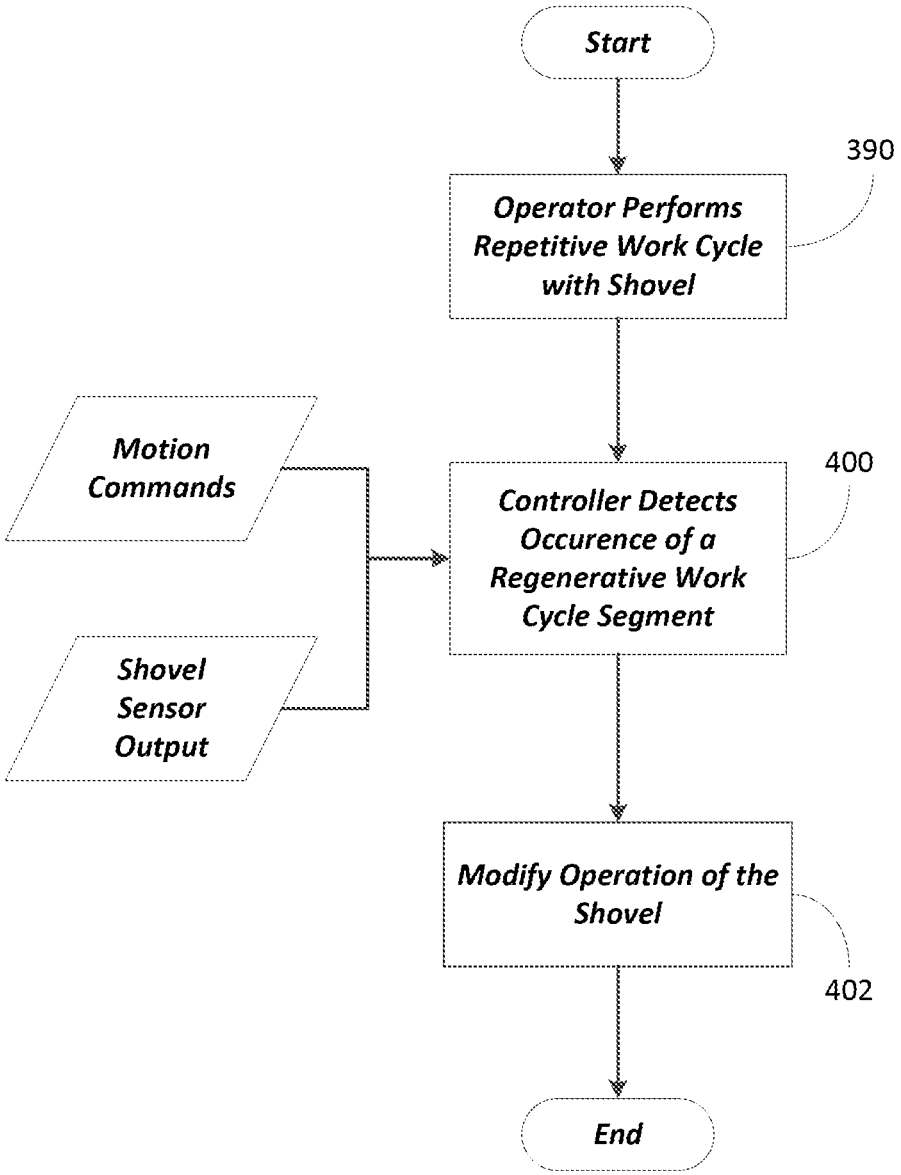
FIG. 5 is a flow chart illustrating a method of managing energy performed by the controller of FIG. 4.

For example, FIG. 5 is a flow chart illustrating a method performed by the controller 300 (by executing instructions with the processing unit 350) to manage energy used and created by the shovel 100. As illustrated in FIG. 5, as the operator performs the repetitive work cycle with the shovel 100 (at block 390), the controller 300 is configured to detect the occurrence of a regenerative work cycle segment (at block 400). As noted above, the shovel 100 performs a repetitive work cycle that includes a plurality of work cycle segments performed in a predetermined sequence. One or more of the work cycle segments can generate regenerative energy and, hence, be considered a regenerative work cycle segment. To detect a regenerative work cycle segment, the controller 300 can be configured to detect a current work cycle segment being performed by the shovel 100. In some embodiments, the controller 300 uses the motion commands received through the user interface 370, information received from the sensors 380, and (optionally) information received from the PCUs 208 to determine the current work cycle segment (e.g., dig, swing, dump, or return). As noted above, algorithms for determining and tracking a work cycle exist and can be used by the controller 300. Alternatively or in addition, a separate controller can be configured to determine or track a current work cycle segment and can provide an identifier of the current work cycle segment to the controller 300.

After determining the current work cycle segment, the controller 300 identifies whether the current work cycle segment is a regenerative work cycle segment (e.g., using a look-up table or other data stored in the modules 355). Alternatively or in addition, the controller 300 (1) determines a subsequent work cycle segment (e.g., the next work cycle segment) based on the current work cycle segment and the sequence of work cycle segments included in the repetitive work cycle and (2) identifies whether the subsequent work cycle segment is a regenerative work cycle segment. When the controller 300 determines that the current and/or subsequent work cycle segment is a regenerative work cycle segment, the controller 300 modifies operation of the shovel 100 to increase energy efficiency (at block 402).

For example, in some embodiments, the controller 300 modifies the shovel 100 by using regenerative energy to increase the speed of the engine 202 above the nominal operating speed. In particular, the generator 204 can use regenerative energy supplied over the bus 206 to drive or assist mechanical components of the engine 202 and other components mechanically coupled to the engine 202, such as the pump drive transmission 200. Since energy is a function of the square of the change in rotational speed, the increased engine speed results in increased energy storage or availability. Augmenting inertia to the engine 202 and/or the pump drive transmission 200, such as with a flywheel, also allows for further increased energy storage as rotating inertia. Additional power train inertia can also be used to compensate for engine control fluctuations during dynamic portions of a work cycle. Stored rotational energy can then be consumed during non-regenerative work cycle segments, which improves machine efficiency. In addition, the increased energy storage capacity resulting from the increased engine speed can reduce or eliminate the need for energy storage devices, such as ultra-capacitors or batteries, which reduces machine cost and weight and improves reliability.

Additionally or alternatively, the controller 300 can modify the operation of the shovel 100 by commanding an engine speed reference lower than the nominal operating speed of the engine 202 in anticipation of a regenerative work cycle segment. When the engine 202 uses a closed-loop speed control scheme, a lower engine speed reference causes the engine 202 to decrease fuel intake (e.g., controlled by an engine controller) until the lower speed reference is achieved. Commanding a lower engine speed prior to the start of a regenerative work cycle segment allows for a greater change in rotational drive line speed when driving or assisting driving the engine 202 and other mechanically-coupled loads with regenerative energy. Therefore, lowering the nominal operating speed allows for increased energy storage or availability, and the stored rotational energy can be consumed during non-regenerative work cycle segments, which improves machine efficiency. Also, the increased energy storage capacity resulting from a lowered engine speed reference can reduce or eliminate the need for energy storage devices, such as ultra-capacitors or batteries, which reduces machine cost and weight and improves reliability.

Additionally or alternatively, the controller 300 can modify the operation of the shovel 100 by reducing the bus voltage in anticipation of a regenerative work cycle segment. The reduced bus voltage commanded by the controller 300 improves overall energy storage capability because of a larger allowable change in bus voltage. Increased stored energy will also be achieved because a greater change in bus voltage will be allowed during the regenerative work cycle segment. The stored energy can be consumed in non-regenerative work cycle segments, which improves machine energy efficiency. Energy storage can also be augmented by coupling additional storage devices, such as ultra-capacitors or batteries, to the bus 206. However, the increased energy storage capacity that results from reducing the bus voltage can reduce or eliminate the need for energy storage devices, such as ultra-capacitors or batteries, which reduces machine cost and weight and improves reliability.

Thus, embodiments of the invention provide, among other things, energy management systems and methods for industrial equipment, such as equipment used for mining and construction environments. However, it should be understood that the energy management systems and methods described herein can be used with any device or system having predictable work or duty cycles. Therefore, the specifics of the shovel 100 described in the present document do not limit the scope of the present invention, and the described energy management systems and methods can be used with other types of shovels, other mining machinery, other industrial machinery, and other non-industrial machinery. For example, manufacturing and assembly machinery, transit systems (e.g., rail and/or tram systems), and other systems having a repetitive and predictable operational cycle or sequence can use the energy management systems and methods described herein.

Furthermore, it should be understood that the controller 300 can be configured to modify operation of the shovel 100 for a regenerative work cycle segment prior to the start of and/or during any portion of a regenerative work cycle segment. In particular, as used in the present application, modifying operation "for" a regenerative work cycle segments includes modifying operation prior to the start and/or during any portion of the segment. For example, in some embodiments, the controller 300 is configured to modify operation of the shovel 100 approximately immediately after detecting the occurrence of a current or subsequent regenerative work cycle segment. The controller 300 can also be configured to perform the modification prior to the start of a regenerative work cycle segment and, in some, embodiments, maintains the modification for the duration of the regenerative work cycle segment. During or after the regenerative work cycle segment, the controller 300 can be configured to undo the modification (e.g., return the engine 202 to a normal or non-modified operating speed and/or return the power bus 206 to a normal or non-modified operating voltage—e.g., the operating speed and/or operating voltage used prior to the modification). For example, the controller 300 can be configured to detect the end of a regenerative work cycle segment (e.g., by detecting the start of a subsequent non-regenerative work cycle segment) and return the shovel 100 to non-modified operating conditions before, at, or after the end of the regenerative work cycle segment.

It should also be understood that the above energy management methods can be combined in various configurations. For example, in some embodiments, the controller 300 is configured to modify the voltage of the bus 206 but not modify operation of the engine 202 or vice versa prior to and/or during the regenerative work cycle segment. Also, in some embodiments, the controller 300 is configured to perform different modifications during different portions of a regenerative work cycle segment (e.g., modify the bus 206 prior to the start of the regenerative work cycle segment or during a first portion of a regenerative work cycle segment and modify the engine 202 during a second portion of the regenerative work cycle segment). The desired modifications or combinations can depend on the machinery, device, or system being controlled and/or the associated operating environment. In addition, it should be understood that power supplied by the generators can be directed to other components of the shovel 100 (such as alternators or compressors) than those described herein.

Various features and advantages of the invention are set forth in the following claims.

What is claimed is:

1. An industrial machine performing a plurality of work cycle segments wherein at least one of the plurality of work cycle segments is a regenerative work cycle segment, the regenerative work cycle segment being a work cycle segment when consumed machine power is negative, the industrial machine comprising:

at least one controller configured to (1) detect a current work cycle segment of the plurality of work cycle segments, (2) detect whether the current work cycle segment or a work cycle segment of the plurality of work cycle segments subsequent to the current work cycle segment is a regenerative work cycle segment, and (3) directly modify operation of an engine included in the industrial machine when the current work cycle segment or the work cycle segment of the plurality of work cycle segments subsequent to the current work cycle segment is the regenerative work cycle segment in order to consume regenerative power generated during the regenerative work cycle segment with at least one actuator included in the industrial machine.

2. The industrial machine of claim 1, wherein the at least one controller is configured to modify the operation of the engine by increasing a speed of the engine.

3. The industrial machine of claim 1, wherein the at least one controller is configured to modify the operation of the engine by decreasing a speed of the engine.

4. The industrial machine of claim 1, wherein the at least one controller is configured to modify the operation of the engine prior to a start of the regenerative work cycle segment.

5. The industrial machine of claim 1, further comprising a dipper performing the plurality of work cycle segments.

6. The industrial machine of claim 5, further comprising at least one sensor configured to detect a position of the dipper.

7. The industrial machine of claim 6, wherein the at least one sensor includes at least one of a crowd sensor, a swing sensor, and a hoist sensor.

8. The industrial machine of claim 6, wherein the plurality of work cycle segments includes a dig segment, a swing segment, a dump segment, and a return segment.

9. The industrial machine of claim 5, wherein the controller is configured to detect the current work cycle segment based on information from the at least one sensor.

10. The industrial machine of claim 5, further comprising an operator interface configured to receive at least one motion command.

11. The industrial machine of claim 10, wherein the at least one motion command includes at least one of a crowd control, a swing control, a hoist control, and a door control.

12. The industrial machine of claim 10, wherein the controller is configured to detect the current work cycle segment based on the at least one motion command.

13. A method of operating an industrial machine performing a plurality of work cycle segments wherein at least one of the plurality of work cycle segments is a regenerative work cycle segment, the regenerative work cycle segment being a work cycle segment when consumed machine power is negative, the method comprising:

detecting, by a controller, a current work cycle segment of the plurality of work cycle segments;

detecting, by the controller, whether the current work cycle segment or a work cycle segment of the plurality of work cycle segments subsequent to the current work cycle segment is a regenerative work cycle segment; and directly modifying, by the controller, operation of an engine included in the industrial machine when the current work cycle segment or a work cycle segment of the plurality of work cycle segments subsequent to the current work cycle is the regenerative work cycle segment in order to consume regenerative power generated during the regenerative work cycle segment with at least one actuator included in the industrial machine.

14. The method of claim 13, wherein modifying the operation of the engine includes modifying the operation of the engine prior to a start of the regenerative work cycle segment.

15. The method of claim 13, wherein modifying the operation of the engine includes increasing a speed of the engine.

16. The method of claim 13, wherein modifying the operation of the engine includes decreasing a speed of the engine.

17. The method of claim 13, further comprising returning the engine to non-modified operation after an end of the regenerative work cycle segment.

18. An energy management system included in a machine comprising:

a power conversion unit generating regulated electrical energy;

an actuator receiving regulated electrical energy from the power conversion unit to operate at least one tool performing a plurality of work cycle segments wherein at least one of the plurality of work cycle segments is a regenerative work cycle segment, the regenerative work cycle segment being a work cycle segment when consumed machine power is negative;

an engine;

a motor-generator coupled to and driven by the engine, the motor-generator generating electrical energy; and a controller configured to (1) detect a current work cycle segment of the plurality of work cycle segments, (2) detect whether the current work cycle segment or a work cycle segment of the plurality of work cycle segments subsequent to the current work cycle segment is a regenerative work cycle segment, and (3) directly modify operation of the engine when the current work cycle segment or the work cycle segment of the plurality of work cycle segments subsequent to the current work cycle segment is the regenerative work cycle segment in order to consume the regenerative power generated during the one of the plurality of work cycle segments with the actuator.

19. The energy management system of claim 18, wherein the controller is configured to modify the operation of the engine by increasing a speed of the engine.

20. The energy management system of claim 18, wherein the controller is configured to modify the operation of the engine by decreasing a speed of the engine.

21. The energy management system of claim 18, wherein the motor-generator drives the engine during the one of the plurality of work cycle segments.

* * * * *